US005216993A

United States Patent [19]

Knorreck et al.

[11] Patent Number: 5,216,993

[45] Date of Patent: Jun. 8, 1993

[54] FUEL INJECTION PUMP FOR INTERNAL COMBUSTION ENGINES

[75] Inventors: Peter Knorreck, Weissach, Fed. Rep. of Germany; Karl Kirchweger, Haidershofen, Austria

[73] Assignee: Robert Bosch GmbH, Stuttgart, Fed. Rep. of Germany

[21] Appl. No.: 967,501

[22] Filed: Oct. 28, 1992

[30] Foreign Application Priority Data

Oct. 29, 1991 [DE] Fed. Rep. of Germany ..... 4135595

[51] Int. Cl.[5] ..... F02M 41/00

[52] U.S. Cl. ..... 123/447; 123/449

[58] Field of Search ..... 123/447, 449, 450

[56] References Cited

U.S. PATENT DOCUMENTS

| | | | |
|---|---|---|---|
| 4,598,683 | 7/1986 | Ohmori et al. | 123/447 |
| 4,709,679 | 12/1987 | Djordjevic et al. | 123/447 |
| 4,765,302 | 8/1988 | Ikeuchi | 123/449 |
| 4,940,037 | 7/1990 | Eckert | 123/447 |
| 4,971,012 | 11/1990 | Brunnel et al. | 123/450 |
| 4,976,236 | 12/1990 | Brunel | 123/450 |
| 4,976,244 | 12/1990 | Eckert | 123/447 |
| 5,044,345 | 9/1991 | Collingborn | 123/450 |
| 5,078,113 | 1/1992 | Haag et al. | 123/450 |

FOREIGN PATENT DOCUMENTS 3920459 1/1991 Fed. Rep. of Germany .

*Primary Examiner*—E. Rollins Cross
*Assistant Examiner*—Thomas N. Moulis
*Attorney, Agent, or Firm*—Edwin E. Greigg; Ronald E. Greigg

[57] ABSTRACT

The fuel injection pump having a pump piston, which has a forward segment and a rear segment of larger diameter The pump piston operates in a cylinder bore with two bore segments of different diameters, corresponding to the pump piston diameters. In the forward bore segment, the forward piston segment defines a pump work chamber, which can be made to communicate with a fuel reservoir via an electrically actuated valve. The rear segment and the rear piston segment of defines an annular work chamber, which communicates with a fuel conduit and a distributor body communicates, in an intake stroke of the pump piston, with a fuel-filled suction chamber. In the supply stroke of the pump piston, the piston work chamber is reduced in size and fuel is positively displaced from the piston work chamber and pumped into the fuel reservoir. In the intake stroke of the pump piston, the pump work chamber is filled from the fuel reservoir. From the pump work chamber, in a known manner, fuel is pumped to the injection locations via a distributor groove in the pump piston and via pressure conduits provided in the distributor body in a number corresponding to the number of engine cylinders.

22 Claims, 2 Drawing Sheets

FUEL INJECTION PUMP FOR INTERNAL COMBUSTION ENGINES

BACKGROUND OF THE INVENTION

The invention is based on a fuel injection pump for internal combustion engines as defined hereinafter.

A fuel injection pump of this type is known from German Patent Application 39 20 459 A1. This fuel injection pump has a pump piston, guided in a cylinder bore, and defining a pump work chamber, the pump piston being fed into simultaneously rotating and reciprocating motion by a drive mechanism. During a given intake stroke and during a controlled portion of the supply stroke of the pump piston, the pump work chamber can be made to communicate, via a connection controlled by an electric valve, with a suction chamber serving as a fuel reservoir. Via a distributor opening disposed in a distributor, the pump work chamber can be made to communicate during a given supply stroke of the pump piston, with one of a plurality of pressure conduits which communicate via injection lines with the injection locations at the engine. The pumping of fuel under high pressure is determined by the closing phase of the valve.

To pump fuel into the suction chamber, a separate feed pump is necessary, which means major engineering effort and expense. The drive mechanism for the pump piston is disposed in the suction chamber and is surrounded by diesel fuel, which serves to lubricate the drive mechanism. However, at high injection pressures the lubricating action of the fuel is no longer sufficient, so that damage to the drive mechanism can occur. For use with Otto internal combustion engines, the known fuel injection pump is unsuitable since the Otto-type fuel has no lubricating action, and because of its disposition in the suction chamber the drive mechanism cannot be lubricated with oil, since the oil would get into the fuel.

OBJECT AND SUMMARY OF THE INVENTION

The fuel injection pump for internal combustion engines according to the invention has the advantage over the prior art that the pump piston simultaneously acts as a piston of a feed pump, so that no separate feed pump is needed.

The disclosure recites advantageous features and embodiments of the fuel injection pump. The device includes pump piston segments which can be guided tightly in two segments of the cylinder bore without the danger of seizing. The drive mechanism of this invention may be embodied for lubrication with oil, for example, yet the oil and fuel cannot mix, so that higher injection pressures can be obtained with the fuel injection pump. In the fuel reservoir, fuel can be stored under pressure, and from it rapid filling of the pump or chamber in the intake stroke of the pump piston is assured.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
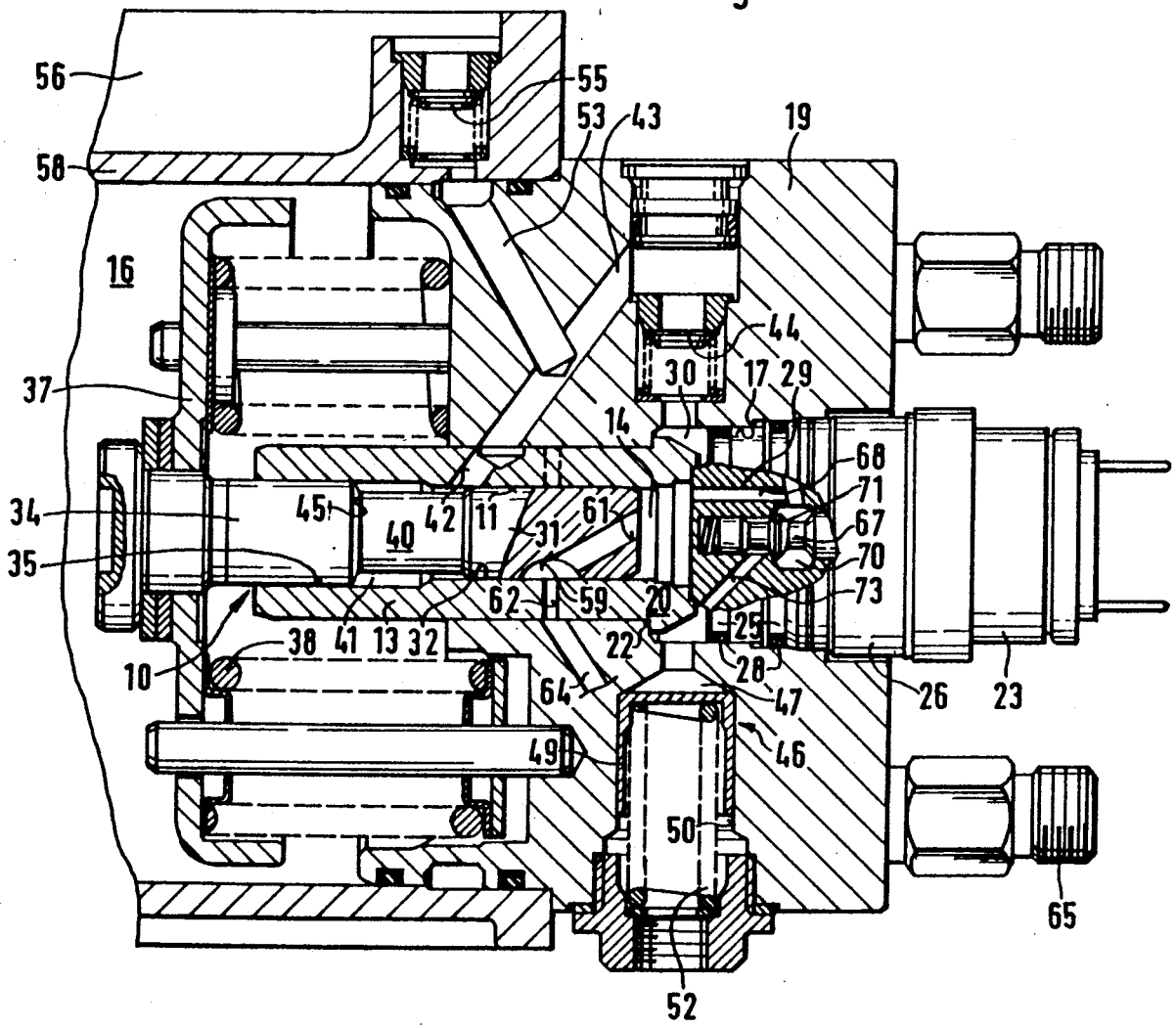
FIG. 1 is a detail in longitudinal section through a first exemplary embodiment of the fuel injection pump.

A fuel injection pump of the distributor type for internal combustion engines, shown in FIG. 1, has a pump piston 10 that operates in a cylinder bore 11 in a cylinder liner 13. With a face end located in the cylinder bore 11, the pump piston 10 defines the pump work chamber 14. In a known manner, the pump piston is set into rotating and simultaneously reciprocating motion by a drive mechanism, not shown. The drive mechanism may for instance be embodied by a stroke disk that rolls along rollers supported in a fixed roller race. The drive mechanism is disposed in an internal chamber 16 of the fuel injection pump.

The cylinder liner 13 is inserted into a bore 17 in a pump housing part 19 embodied as a distributor body. The bore 17 in the distributor body 19 is embodied as continuous, and toward the outside of the distributor body it has a larger diameter than toward the internal chamber 16 of the pump housing. The cylinder liner 13 is supported with a flange 20 toward the internal chamber 16 on the annular shoulder 22 formed between the different diameters of the bore 17. In its end region located in the bore 17, the flange 20 is embodied conically, with a tapering cross section toward its end along a circumference. The cylinder bore 11 has an enlarged diameter in its end region in the cylinder liner 13 disposed in the bore 17. In the region of the larger diameter of the bore 17, an electrically controlled valve 23 is inserted from outside, closing the bore 17. The valve 23 is embodied as a magnet valve, for instance. Toward the outside, the bore 17 is sealed off by two sealing rings 28 placed, spaced apart from one another, each in one annular groove 25 on the outer circumference of the valve housing 26. A valve body 29 is inserted into the valve housing 26 and protrudes with its end region out of the valve housing toward the cylinder liner 13 and plunges into the end of the cylinder bore 11, closing it. As a result of this embodiment, an annular chamber 30 is defined in the bore 17 between the ends of the cylinder liner 13, the valve body 29 and the valve housing 26.

In the first exemplary embodiment, shown in FIG. 1, the pump piston 10 has a first, forward segment 31, having a first diameter, which is tightly guided in a first, forward segment 32 of the cylinder bore 11, and by the face end of which the pump work chamber 14 is defined. The pump piston 10 also has a second, rear segment 34 of larger diameter, which is tightly guided in a second, rear segment 35 of the cylinder bore 11 and protrudes out of the cylinder bore 11 toward the internal chamber 16 of the pump housing. The rear segment 34 of the pump piston 10 is coupled in an axial direction with a carrier 37 that is supported o the distributor body 19 via a plurality of helical compression springs 38. The springs 38 assure that the stroke disk of the drive mechanism will not lift away from the rollers of the roller race. The pump piston 10 has a third, middle segment 40 between the two segments 31 and 34, which has a somewhat smaller diameter than the forward segment 31. An annular work chamber 31 is defined in the rear segment 35 of the cylinder bore 11 by the annular phase 45 formed at the transition between the middle segment 40 and the rear segment 34 of the pump piston 10.

A bore 42 in the cylinder liner 13 leads away from the cylinder bore 11, in its end region of the forward segment 32 pointing toward the internal chamber 16 of the pump housing, and the bore 42 discharges into a fuel conduit 43 in the distributor body 19.

The fuel conduit 43 communicates with the annular chamber 30, formed by the conical end of the cylinder 13 in the bore 17, via a first check valve 44. The first check valve 44 opens toward the annular chamber 30. Communicating with the annular chamber 30 is a fuel reservoir 46, which has a reservoir chamber 47 that is defined by a piston 49 and a cylinder bore 50 disposed radially to the pump piston 10. The piston 49 is displacable in the cylinder bore 50 counter to the force of a compression spring 52. From the fuel conduit 43, between the cylinder liner 13 and the check valve 44, a conduit 53 splits off and connects with a second check valve 55 slated on a valve seat which prevents fuel flow into a fuel-filled suction chamber 56 of the fuel injection pump. The second check valve 55 is disposed in a pump housing part 58 defining the suction chamber 56 and is pressed by a spring onto its valve seat, and it opens from the suction chamber 56 toward the conduit 53 by compression of the spring. The suction chamber 56 is separated from the internal chamber 16 of the fuel injection pump, in which the drive mechanism is disposed.

In its forward segment 31, the pump piston 10 has a distributor groove 59 on its circumference, which communicates with the pump work chamber 14 via a bore 61 in the pump piston 10. Radial bores 62 lead away from the cylinder bore 11, distributed uniformly over its circumference and corresponding in number to the number of cylinders of the engine operated with the fuel injection pump. Each of the bores 62 discharges into a pressure conduit 64, which communicates with an injection location of the engine via a pressure valve 65 and an injection line.

The electrically actuated valve 23 has a valve member 67, by which a valve opening 71, formed in a valve chamber 70 that communicates with the pump work chamber 14 via a longitudinal bore 68 in the valve body 29, can be closed. The valve opening 71 enables communication of the valve chamber 70 with the annular chamber 30 and thus with the reservoir chamber 49, via a bore 73 in the valve body 29.

The function of the above-described fuel injection pump will now be explained. In the intake stroke of the pump piston 10, fuel flows from the suction chamber 56, through the opened check valve 55, the conduit 53, the fuel conduit 43 and the bore 42 in the cylinder liner 13, to reach the enlarging work chamber 41. With the opened valve 23, the pump work chamber 14 is also filled with fuel flowing out of the reservoir chamber 47 through the annular chamber 30, the bore 73, the valve chamber 70 and the longitudinal bore 68. The first check valve 44 is closed, since a higher pressure prevails in the annular chamber 30 communicating with the reservoir chamber 47 than in the fuel conduit 43. In the supply stroke of the pump piston 10, the work chamber 41 decreases in size, so that fuel is positively displaced out of it. The middle segment 40 of the pump piston 10 then plunges into the forward segment 32 of the cylinder bore 11, and by means of the annular chamber remaining between the middle portion 40 of the pump piston 10 and the cylinder bore 11 fuel is positively displaced into the reservoir chamber 47, through the bore 42 in the cylinder liner 13, the fuel conduit 43, the opened first check valve 44 and the annular chamber 30. The check valve 55 toward the suction chamber 56 is closed during this time. The piston 49 of the fuel reservoir 46 is displaced, in order to enlarge the reservoir chamber 47 for receiving the fuel. This compresses the spring 52, so that the fuel is stored under pressure in the reservoir chamber 47.

At a predetermined time in the supply stroke of the pump piston 10, the valve 23 is closed, and high pressure is built up in the pump work chamber 14. The opening and closing duration and the opening and closing instant of the valve 23 can be controlled as a function of various operating parameters, such as engine RPM or load. In a predetermined rotary position of the pump piston 10, the distributor groove 59 communicates with one of the radial bores 62 and via it with one of the pressure conduits 64 and the applicable injection location of the engine via a pressure valve 65.

To terminate the high-pressure pumping, the valve 23 is opened, and fuel flows out of the pump work chamber 14 through the valve 23 into the annular chamber 30 and the reservoir chamber 47. The piston 49 of the fuel reservoir 46 is displaced farther in the process, counter to the force of the spring 52. In the next intake stroke of the pump piston 10, as described above, the pump work chamber 14 is then refilled with fuel from the reservoir chamber 47 and the work chamber 41 is refilled with fuel from the suction chamber 56. The pump work chamber 14 is then rapidly filled with the fuel under pressure from the fuel reservoir 46, which is necessary especially at high rpm of the fuel injection pump, because of the short time periods that are then available. The drive mechanism disposed in the internal chamber 16 of the fuel injection pump may be embodied such that it is oil-lubricated.

Figure 2:
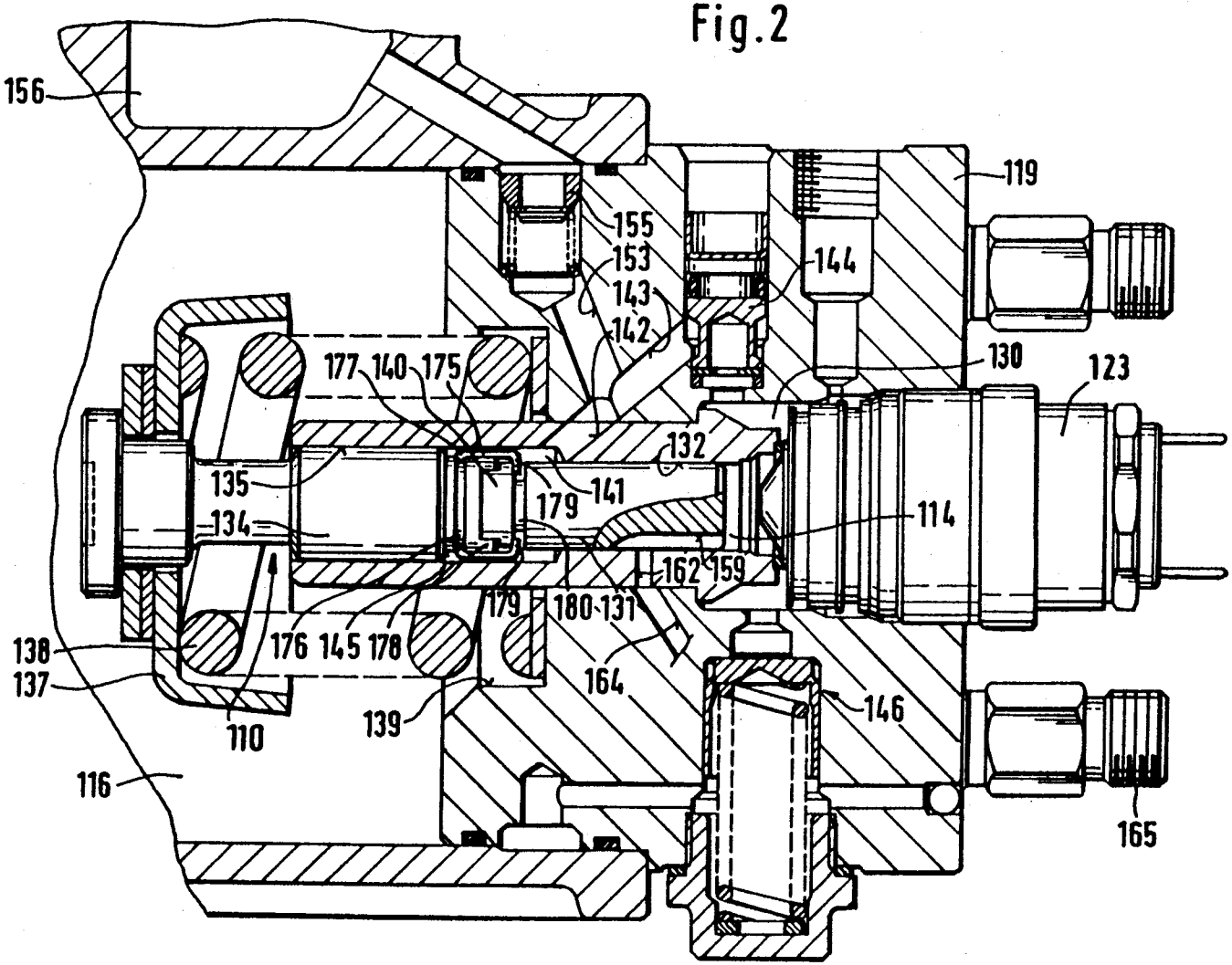
FIG. 2 is a detail in longitudinal section through a second exemplary embodiment of a fuel injection pump.

In a second exemplary embodiment shown in FIG. 2, the pump piston likewise has two segments 131 and 134 with different diameters. The first, forward segment 131 defines the pump work chamber 114 in a first segment 132 of the cylinder bore 111. The second, rear segment 134 having the larger diameter is formed on a separate part of the pump piston 110 and is tightly guided in a second, rear segment 135 of the cylinder bore 111 and having a suitably larger diameter. The rear segment 134 of the pump piston 110 is connected in the axial direction to a spring plate 137, on which a helical compression spring 138 coaxially surrounding the pump piston 134 is supported, this spring being supported on the other end in an indentation 139 in the distributor body 119 and pulling the pump piston 134 toward the internal chamber 116 of the fuel injection pump.

The two pump piston segments 131 and 134 may for instance be coupled rotationally to one another via a claw coupling 140. The claw coupling 140 enables a radial displacement of the pump piston segments 131 and 134 relative to one another, or in other words a displacement from a common axis of the pump piston parts relative to one another, to enable compensating for varying alignments of the segments 132 and 135 of the cylinder bore 111 dictated by production tolerances. The forward pump piston segment 131 is held in contact with the rear pump piston segment 134 by the pressure prevailing in the pump work chamber 114.

In the second exemplary embodiment shown in FIG. 2, the two pump piston segments 131 and 134 are additionally joined in the axial direction by means of a retaining element 175. The retaining element 175 surrounds the pump piston segments 131 and 134 annularly in the region of the claw coupling 140 and has a longitudinal slit by means of which the retaining element 175 is given radial elasticity. The retaining element 175 is locked into place on one of the pump piston segments 134, in an annular groove 176, with an encompassing protrusion 177 and rests radially with prestressing on the end segment 178 of the rear pump piston segment 134. With arms 179, for instance two in number, which can be deformed elastically both radially and axially, the retaining element 175 engages an annular groove 180 in the other pump piston segment 131; the arms 179, in a prestressed manner, engage the side of the annular groove 180 pointing away from the claw coupling 140, and the two pump piston segments 131 and 134 are coupled axially without play. The retaining element 175 can be installed and removed only with the pump piston 110 removed; the retaining element 175 cannot be loosened in the cylinder bore 111.

The rear pump piston segment 134 defines a work chamber 141 in the cylinder bore 135. In the transition region between the two different diameters, a bore 142 leads away from the cylinder bore 111 and discharges into a fuel conduit 143 in the distributor body 119. The fuel conduit 143 communicates with an annular chamber 130 and a fuel reservoir 146 via a check valve 144. The fuel reservoir 146 is embodied as described for the first exemplary embodiment. Between the cylinder bore 111 of the check valve 144, a conduit 153 branches off from the fuel conduit 143; via a further check valve 155, the conduit 153 discharges into a fuel-filled suction chamber 156 of the fuel injection pump. The check valve 155 is disposed in the distributor body 119. The suction chamber 156 is separated from the internal chamber 116 of the fuel injection pump.

On its circumference, the forward pump piston segment 131 has a distributor groove 179 that extends as far as the forward face end of that segment. As in the first exemplary embodiment, radial bores 162 corresponding in number to the cylinders of the engine lead away from the cylinder liner 113, and these bores each communicate with the engine injection locations, via a respective pressure conduit 164 in the distributor body 119 and a pressure valve 165. The valve 123 is embodied as described for the first exemplary embodiment. The function of the fuel injection pump of the second exemplary embodiment is likewise as described for the first exemplary embodiment.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. A fuel injection pump for internal combustion engines, having a pump piston (10; 110) guided in a cylinder bore (11; 111), which piston defines a pump work chamber (14; 114) and is set into rotating and simultaneously reciprocating motion by a drive mechanism, wherein the pump work chamber (14; 114), during a given intake stroke and during a controlled portion of a supply stroke of the pump piston (10; 110), is made to communicate, via a connection controlled by an electrically actuated valve (23; 123), with a fuel reservoir (46; 146) into which fuel is pumped, the pump work chamber (14; 114) is made to communicate, during a given supply stroke of the pump piston (10; 110), via a distributor opening (59; 159) disposed in said pump piston (10; 110), with one of a plurality of pressure conduits (64; 164), which communicate via injection lines with an injection location of the engine, and the fuel pumping at high pressure is determined by closing of a valve (23; 123), the pump piston (10; 110) has at least first and second segments (31, 34; 131, 134) of different diameters, wherein the pump work chamber (14; 114) is defined by a face end of the pump piston segment (31; 131) in a first segment (32; 132) of the cylinder bore (11; 111), and an annular work chamber (41; 141), which upon a given intake stroke of the pump piston (10; 110) communicates with a fuel-filled suction chamber (56; 156) and during a given supply stroke of the pump piston (10; 110) said annular work chamber communicates with a fuel reservoir (46; 146), in which fuel under pressure is stored, an annular face (45; 145), is formed at a transition between two pump piston segments (31, 34; 131, 134), in a second segment (35; 135) of the cylinder bore (11; 111).

2. A fuel injection pump as defined by claim 1, in which said pump work chamber (14; 114) is defined by the face end of the pump piston segment (31; 131) having the smaller diameter.

3. A fuel injection pump as defined by claim 2, in which the pump piston segments (131, 134) of the pump piston (110) are embodied with different diameters spaced axially from each other.

4. A fuel injection pump as defined by claim 3, in which the pump piston segments (131, 134) are coupled in a rotational direction with one another, which enables a radial displacement relative to one another.

5. A fuel injection pump as defined by claim 4, in which the pump piston segments (131, 134) are coupled to one another by means of a claw coupling 140.

6. A fuel injection pump as defined by claim 4, in which the pump piston segments (131, 134) are coupled axially with one another.

7. A fuel injection pump as defined by claim 5, in which the pump piston segments (131, 134) are coupled axially with one another.

8. A fuel injection pump as defined by claim 6, in which the two pump piston segments (131, 134) are Coupled to one another in the axial direction by means of a retaining element (175), which is locked into place in one of the two pump piston segments and which with resiliently embodied arms (179) radially engages the other pump piston segment in a prestressed manner.

9. A fuel injection pump as defined by claim 1, in which the drive mechanism is disposed in an internal chamber (16; 116) of the fuel injection pump, which chamber is separate from the suction chamber (56; 156).

10. A fuel injection pump as defined by claim 2, in which the drive mechanism is disposed in an internal chamber (16; 116) of the fuel injection pump, which chamber is separate from the suction chamber (56; 156).

11. A fuel injection pump as defined by claim 3, in which the drive mechanism is disposed in an internal chamber (16; 116) of the fuel injection pump, which chamber is separate from the suction chamber (56; 156).

12. A fuel injection pump as defined by claim 4, in which the drive mechanism is disposed in an internal chamber (16; 116) of the fuel injection pump, which chamber is separate from the suction chamber (56; 156).

13. A fuel injection pump as defined by claim 5, in which the drive mechanism is disposed in an internal chamber (16 116) of the fuel injection pump, which chamber is separate from the suction chamber (56; 156).

14. A fuel injection pump as defined by claim 6, in which the drive mechanism is disposed in an internal chamber (16 116) of the fuel injection pump, which chamber is separate from the suction chamber (56; 156).

15. A fuel injection pump as defined by claim 1, in which a check valve (55; 155) which opens toward the annular work chamber (41; 141) is disposed between the annular work chamber (41; 141) and the suction chamber (56; 156).

16. A fuel injection pump as defined by claim 2, in which a check valve (55; 155) which opens toward the annular work chamber (41; 14 ) is disposed between the annular work chamber (41; 141) and the suction chamber (56; 156).

17. A fuel injection pump as defined by claim 3, in which a check valve (55; 155) which opens toward the annular work chamber (41; 141) is disposed between the annular work chamber (41; 141) and the suction chamber (56; 156).

18. A fuel injection pump as defined by claim 4, in which a check valve (55; 155) which opens toward the annular work chamber (41; 141) is disposed between the annular work chamber (41; 141) and the suction chamber (56; 156).

19. A fuel injection pump as defined by claim 5, in which a check valve (55; 155) which opens toward the annular work chamber (41; 141) is disposed between the annular work chamber (41; 141) and the suction chamber (56; 156).

20. A fuel injection pump as defined by claim 6, in which a check valve (55; 155) which opens toward the annular work chamber (41; 141) is disposed between the annular work chamber (41; 141) and the suction chamber (56; 156).

21. A fuel injection pump as defined by claim 1, in which a check valve (44; 144) which opens toward the fuel reservoir (46; 146) is disposed between the work chamber (41; 141) and the fuel reservoir (46;146).

22. A fuel injection pump as defined by claim 1, in which the fuel reservoir (46; 146) has a wall (49) that is displacable in a cylinder counter to the force of a spring (52).

* * * * *